US007029003B2

(12) United States Patent
Takeda et al.

(10) Patent No.: US 7,029,003 B2
(45) Date of Patent: Apr. 18, 2006

(54) AUTOMATIC PAPER FEED APPARATUS

(75) Inventors: Kenichi Takeda, Toyonaka (JP); Yoshihiko Ide, Toyonaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 70 days.

(21) Appl. No.: 10/760,451

(22) Filed: Jan. 21, 2004

(65) Prior Publication Data

US 2005/0156371 A1 Jul. 21, 2005

(51) Int. Cl.
*B65H 3/32* (2006.01)

(52) U.S. Cl. ..... 271/113; 271/121; 271/145; 271/167; 271/171

(58) Field of Classification Search ..... 271/113, 271/121, 123, 145, 167, 171
See application file for complete search history.

(56) References Cited

U.S. PATENT DOCUMENTS

| | | | | |
|---|---|---|---|---|
| 3,768,803 | A | 10/1973 | Stange | |
| 5,171,007 | A | 12/1992 | Kasprzak et al. | |
| 6,246,466 | B1 * | 6/2001 | Hirano et al. | 355/407 |
| 6,318,918 | B1 * | 11/2001 | Sasaki et al. | 400/624 |
| 6,478,294 | B1 * | 11/2002 | Hiratani | 271/10.09 |
| 6,793,425 | B1 * | 9/2004 | Yoshikawa et al. | 400/624 |
| 2003/0090051 | A1 | 5/2003 | Allen et al. | |
| 2004/0032076 | A1 * | 2/2004 | Kawakami | 271/121 |

FOREIGN PATENT DOCUMENTS

| | | |
|---|---|---|
| DE | 101 41 707 A1 | 3/2003 |
| EP | 0 381 649 A1 | 8/1990 |
| JP | 49-67620 | 7/1974 |
| JP | 58-69645 | 4/1983 |

* cited by examiner

*Primary Examiner*—David H. Bollinger
(74) *Attorney, Agent, or Firm*—Wenderoth, Lind & Ponack, L.L.P.

(57) ABSTRACT

The present invention provides an automatic paper feed apparatus which can reliably prevent papers from being discharged in an overlapped state in spite of simple construction. The automatic paper feed apparatus comprises a paper feed roller for automatically feeding a plurality of papers in order from an uppermost one, with the plurality of papers being contained in a cassette in a stacked state. A holding member having flexibility is provided so that the holding member comes into contact with the uppermost paper to generate a friction force that is weaker than that between the paper feed roller and the uppermost paper.

19 Claims, 5 Drawing Sheets

AUTOMATIC PAPER FEED APPARATUS

BACKGROUND OF THE INVENTION

The present invention relates to an automatic paper feed apparatus for paper, especially medicine bag.

Conventionally, an automatic paper feed apparatus having, for example, following construction has been known.

Japanese Laid-open patent publication No. 49-67620 discloses an automatic paper feed apparatus in which a brake piece is provided on one end portion of copy papers stacked on the paper feed table to prevent the two copy papers from being conveyed at a time.

Japanese Laid-open patent publication No. 58-69645 discloses an automatic paper feed apparatus in which plates are interposed between stacked papers. The friction coefficient between each plate and paper is smaller than that between papers, preventing the papers from being fed in an overlapped state.

In the former automatic paper feed apparatus, the brake piece have to be provided on each copy paper. In addition, a solenoid and so on is necessary to lift the brake piece so that the copy papers can be discharged from the paper feed table one by one. Thus, there has been a disadvantage that it complicates the construction and invites cost up.

On the other hand, in the latter automatic paper feed apparatus, a complicated operation for interposing the plate between papers has been necessary.

SUMMARY OF THE INVENTION

An object of the invention is to provide an automatic paper feed apparatus which can reliably prevent papers from being discharged in an overlapped state in spite of simple construction.

In order to achieve the object, the present invention provides an automatic paper feed apparatus comprising a paper feed roller for automatically feeding a plurality of papers in order from uppermost one, the plurality of papers being contained in a cassette in a stacked state, wherein a holding member having flexibility is provided so that the holding member comes into contact with the paper to generate a friction force weaker than that between the paper feed roller and the paper.

According to the above construction, when the paper positioned uppermost is conveyed by the paper feed roller, the holding member also comes into contact with the next paper to generate a friction force, preventing the next paper from being conveyed together with the uppermost paper. As the holding member has a flexibility itself, it surely comes into close contact with the paper along the surface of the paper and generates a uniform friction force, properly preventing any trouble of paper feed caused by the paper feed roller.

Preferably, an engagement portion is formed on the rear end portion of the holding member, and wherein the engagement member is engaged with the cassette, whereby the holding member is attached on the cassette slidably with respect to a paper feed direction. In this case, the engagement member may be engaged with a guide portion which is provided in the cassette to guide the rear end of the paper.

According to the above construction, when the paper feed roller rotates, the paper positioned uppermost commences moving due to a friction force between the paper and the paper feed roller. Since the uppermost paper moves together with the holding member put thereon, it is possible to generate a proper friction force between the paper feed roller and the paper. Therefore, smooth conveyance of the paper is made possible.

Even if the paper is a medicine bag and has a different thickness by location, the holding member becomes deformed along the surface of the medicine bags and the friction force to be generated becomes uniform, allowing the medicine bag to convey smoothly.

Preferably, the holding member has a sheet-like shape, and wherein conductive layers comprising different material are formed on the top and bottom surfaces of the holding member. Thus, it is possible to select any proper one of top and bottom faces based on difference of paper and have such face come into contact with the paper.

BRIEF DESCRIPTION OF THE DRAWINGS

Further objects and advantages of the present invention will become clear from the following description taken in conjunction with the preferred embodiments thereof with reference to the accompanying drawings, in which.

DETAILED DESCRIPTION OF THE PREFERRED EMBODIMENTS

Hereinbelow, embodiments of the invention will be described with reference to the accompanying drawings.

Figure 1:
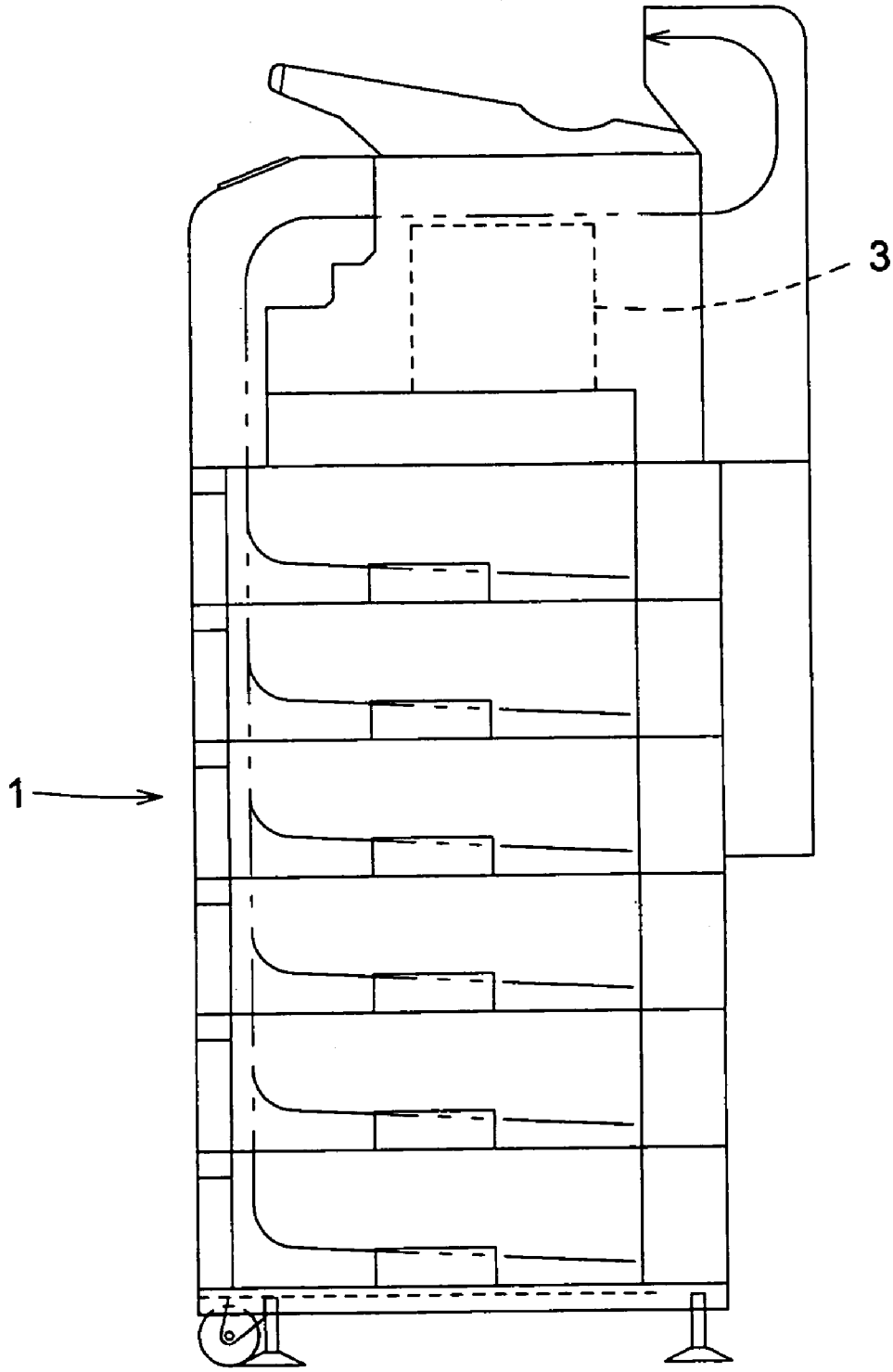
FIG. 1 is a side view of a medicine bag printing apparatus according to an embodiment of the present invention.
Figure 2:
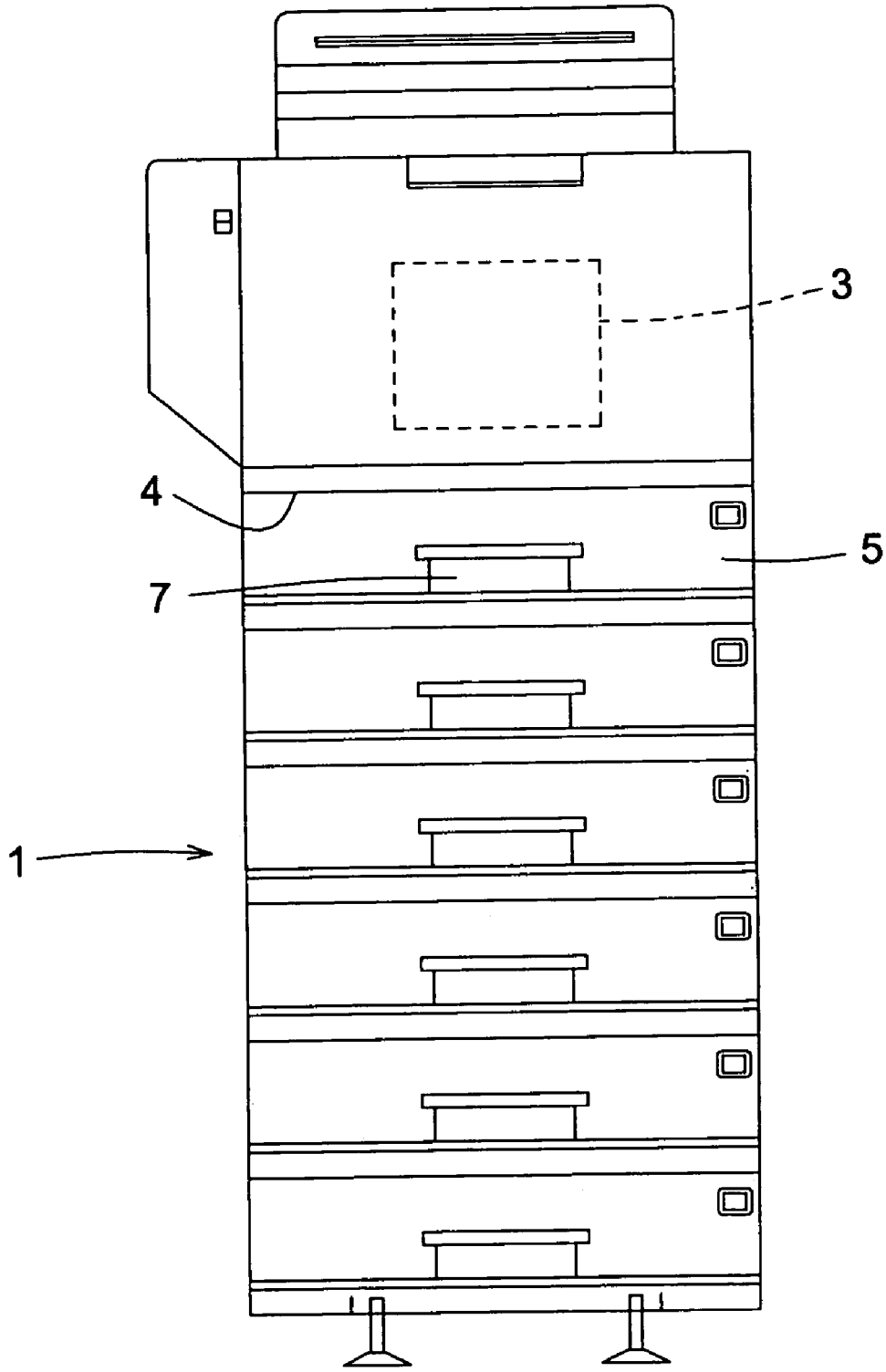
FIG. 2 is a front view of the medicine bag printing apparatus of FIG. 1.

FIGS. 1 and 2 show a medicine bag printing apparatus according to an embodiment of the present invention. The medicine bag printing apparatus comprising an automatic paper feed apparatus 1 and a printing apparatus 3 for conducting a predetermined print on a paper 2 fed from the automatic paper feed apparatus 1. In this embodiment, a medicine bag (refer to FIG. 3) of which both side edges are stuck and become thick is used as a paper 2.

Figure 5:
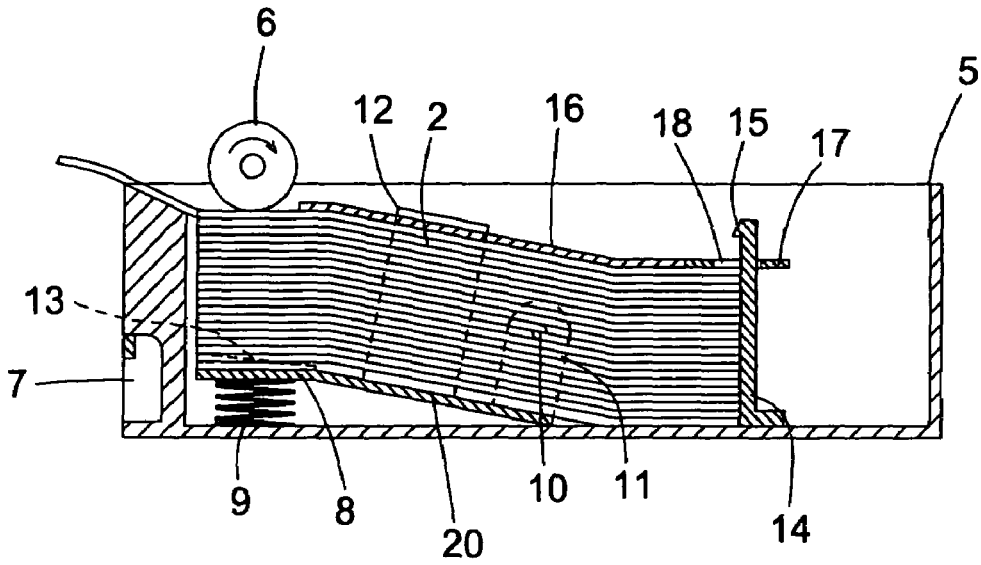
FIG. 5 is a side sectional view of the cassette of FIG. 4.

In the automatic paper feed apparatus 1, a cassettes 5 can be mounted into and dismounted from each of housing spaces 4 formed in multistage in a vertical direction. As shown in FIG. 5, in each housing space 4 is provided a paper feed roller 6 which is driven to rotate by drive means such as motor not shown. The paper feed roller 6 comes into contact with the paper 2 contained in the cassette 5 and positioned uppermost so that the paper 2 is conveyed and fed due to a friction force generated between both. (Hereinafter, a direction in which the paper is fed is referred to as "front" and a reverse direction thereof is referred to as "rear".)

Figure 4:
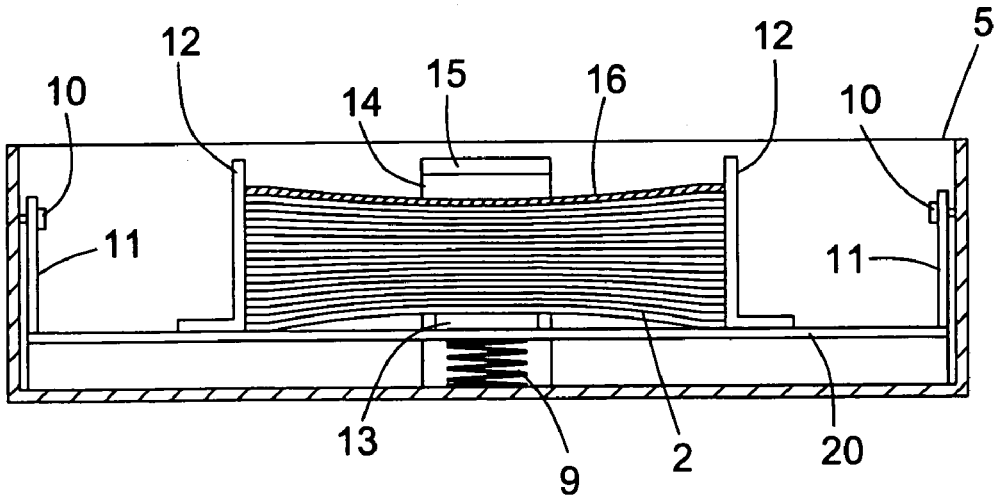
FIG. 4 is a front sectional view of a cassette mounted on the medicine bag printing apparatus of FIGS. 1 and 2.

The cassette 5 has a box like shape with an upper surface opened as shown in FIGS. 4 and 5. On the front end face of the cassette 5 is formed an engagement recess 7 with which fingers of an operator are engaged when the cassette 5 is drawn from the housing space 4. On the bottom of the cassette 5, a support plate 20 is provided pivotably around a support shaft 10 via arms 1l. The flat portion 8 of the support plate 20 positioned on the front end side is urged upward by a spring 9. On the support plate 20, guide plates 12 are slidably provided in a width direction to guide the both side edges of the paper 2 contained in the cassette 5. On the upper face of the flat portion 8 of the support plate 20, guide protrusions 13 are formed to support a middle portion of the medicine bag, i.e., a thinner portion than the side edge portions. On the bottom of the cassette 5 on the rear side, a guide piece 14 is slidably provided in the paper feed direction to guide the rear end of the paper 2. on the upper end of the guide piece 14 is formed an engagement craw 15 protruding toward the front side.

In the cassette 5, the same size of papers 2 are contained in a stacked state. (The size of papers 2 contained in each of the cassettes 5 is same in one case but different in another case.) The papers 2 are sandwiched between the support plate 20 urged upward by the spring 9 and the paper feed roller 6 in a state that the cassette 5 is mounted in the housing space 4.

Figure 7:
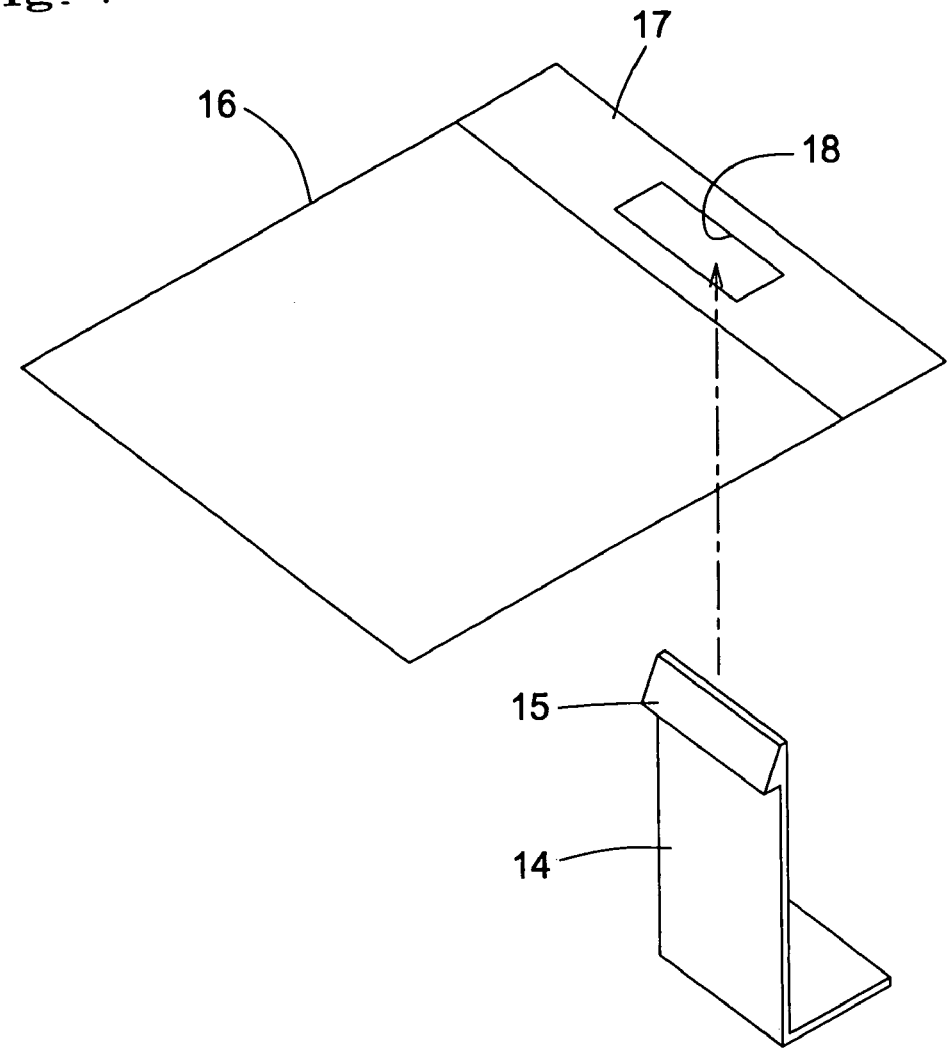
FIG. 7 is a perspective view of the flexible sheet of FIGS. 4 and 5.

On the rear side of the paper feed roller 6, a flexible sheet 16 as an example of the holding member of the present invention is put on the paper 2 contained in the cassette 5. The flexible sheet 16 as shown in FIG. 7 is made of urethane rubber, silicon rubber and so on. The flexible sheet 16 comes into close contact with the paper 2 in an area except a portion pressed by the paper feed roller 6. on the rear end of the flexible sheet 16 is integrally formed an attachment piece 17 that is made of metal material such as stainless steel and has a rectangular shape. In the attachment piece 17 is formed a rectangular engagement hole 18 into which the guide piece 14 is inserted so that the flexible sheet 16 is slidably attached in the paper feed direction of the paper 2.

In the medicine bag printing apparatus of above construction, the paper feed roller 6 is driven to rotate in the housing space 4 in which the cassette 5 containing the papers 2 of size corresponding to a prescription data is mounted. At this time, a friction force is generated between the paper feed roller 6 and the paper 2 urged upward by the spring 9. The spring force is large in comparison to the weight of the flexible sheet 16 which comes into close contact with the upper most paper 2. Therefore, the uppermost paper 2 and the flexible sheet 16 commence moving together as the paper feed roller 6 rotates. Thus, in comparison to a case that no flexible sheet is put on, the state of conveying the paper 2 becomes stable. That is, in the case of only paper 2, there is a possibility that the paper 2 is conveyed on the skew according to a slight difference of condition such as a contact condition between the paper 2 and the paper feed roller 6. On the other hand, in the case that the flexible sheet is put on, since an influence of the weight of the flexible sheet becomes larger, no bad influence is exerted to the conveyance of the paper 2 even if a condition is slightly different, for example, a contact pressure between the paper 2 and the paper feed roller 6 is different in the width direction.

Figure 6:
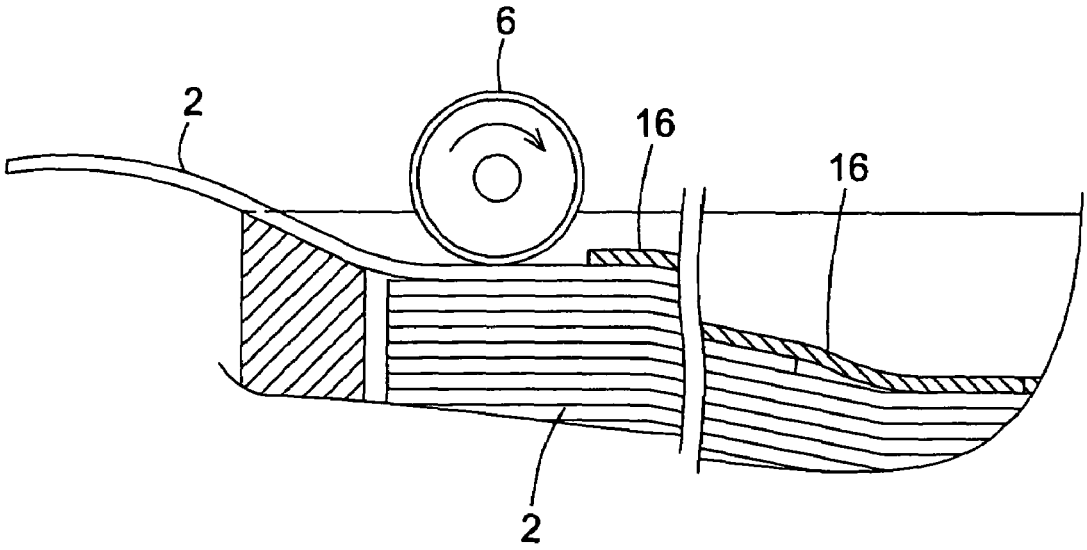
FIG. 6 is a partly enlarged view of FIG. 5.

When the rotation of the paper feed roller 6 allows the paper 2 and the flexible sheet 16 to move, the edge of the engagement hole 18 of the attachment piece 17 comes into contact with the guide piece 14, inhibiting the flexible sheet 16 from moving further. The friction force generated between the paper feed roller 6 and the uppermost paper 2 is larger than the friction force generated between the paper 2 and the flexible sheet 16 which comes into close contact with the paper 2. Therefore, only the paper 2 keeps moving. Movement of only the uppermost paper 2 allows a part of the flexible sheet 16 to come into close contact with the surface of the next paper 2 as shown in FIG. 6. The friction coefficient between the paper 2 and the flexible sheet 17 is lager than the friction coefficient between the papers 2. Therefore, the next paper 2 is prevented from being moved by the friction force from the flexible sheet 16, whereby only the paper 2 positioned uppermost can be conveyed as the paper feed roller rotates.

Thus, in the embodiment explained above, putting the flexible sheet 16 on the stacked paper 2 enables to neglect a slight difference of condition that has been a problem when conveying the paper 2 by the paper feed roller 6, resulting in good conveyance of the paper 2. Therefore, the paper 2 can be conveyed stably on the straight. Even in a case of printing, the printing direction never skews. In addition, after commencement of conveying, the flexible sheet 16 holds the next paper 2, preventing a disadvantage that the papers 2 are conveyed in a overlapped state.

In the embodiment described above, the flexible sheet 16 is explained as an example of the holding member, though the holding member may be a plurality of line-like members or straps or may also a mesh-like member. Also, the holding member may be a sheet-like member with a various kind of shape formed on the surface thereof. Moreover, it is also possible to stick an other member such as sponge on the surface of the holding member to generate a predetermined friction force between such member and the paper 2.

Figure 8:
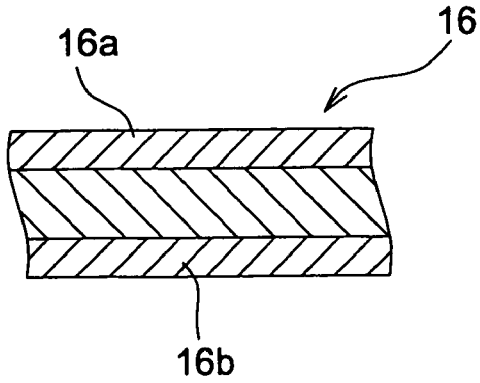
FIG. 8 is an enlarged sectional view of the flexible sheet of FIG. 6.

In addition, a coating of conductive material may be applied on the top face of the flexible sheet 16, or carbon and so on may be impregnated in the surface of the flexible sheet 16, preventing a bad influence due to a static electricity generated on the paper 2. In this case, as shown in FIG. 8, coatings 16*a* and 16*b* of different conductive material (for example, carbon and aluminum) may be preferably applied on the top and bottom faces of the flexible sheet 16 to use either according to the difference (for example, normal quality paper and propylene) of the paper 2 to be used.

As is clear from the above description, according to the present invention, as the flexible sheet is put on the paper in the cassette, it is possible to reliably feed only one paper.

Although the present invention has been fully described by way of the examples with reference to the accompanying drawing, it is to be noted that various changes and modifications will be apparent to those skilled in the art. Therefore, unless such changes and modifications otherwise depart from the spirit and scope of the present invention, they should be construed as being included therein.

What is claimed is:

1. An automatic paper feed apparatus comprising:

a feed roller for automatically feeding papers, when the papers are contained in a cassette in a stacked state, in order from an uppermost one of the papers; and a flexible sheet constructed and arranged to be positioned on the uppermost one of the papers such that when said feed roller automatically feeds the uppermost one of the papers a friction force exists between said flexible sheet and the uppermost one of the papers, with (i) that component of the friction force resulting from said flexible sheet being generated solely from a weight of said flexible sheet and a coefficient of friction of a surface of said flexible sheet that contacts the uppermost one of the papers, and (ii) the friction force being weaker than a friction force existing between said feed roller and the uppermost one of the papers.

2. The automatic paper feed apparatus according to claim 1, further comprising:

an engagement portion on a rear end portion of said flexible sheet, wherein said engagement portion is constructed and arranged to be engaged with the cassette such that said flexible sheet becomes attached to the cassette so as to be slidable in a paper feed direction.

3. The automatic paper feed apparatus according to claim 2, wherein said engagement portion is constructed and arranged to be engaged with the cassette by being constructed and arranged to be engaged with a guide member in the cassette, which guide member is to guide rear ends of the papers.

4. The automatic paper feed apparatus according to claim 1, wherein the papers are medicine bags.

5. The automatic paper feed apparatus according to claim 1, further comprising:

a first conductive layer on a top surface of said flexible sheet; and a second conductive layer on a bottom surface of said flexible sheet, with said first conductive layer being of a material different than a material of said second conductive layer.

6. The automatic paper feed apparatus according to claim 1, wherein said flexible sheet is constructed and arranged to contact a paper immediately adjacent the uppermost one of the papers as the uppermost one of the papers is being fed by said feed roller.

7. The automatic paper feed apparatus according to claim 1, wherein said flexible sheet comprises a urethane rubber flexible sheet or a silicon rubber flexible sheet.

8. The automatic paper feed apparatus according to claim 1, wherein said flexible sheet is constructed and arranged to simultaneously contact the uppermost one of the papers and a paper immediately adjacent the uppermost one of the papers, as the uppermost one of the papers is being fed by said feed roller.

9. The automatic paper feed apparatus according to claim 1, further comprising:

a mechanism for allowing said flexible sheet to slidably move in a direction of thickness of the papers, when in the cassette in the stacked state, in response to the weight of said flexible sheet, and for limiting movement of said flexible sheet in a paper feed direction.

10. The automatic paper feed apparatus according to claim 9, wherein said mechanism comprises (i) a guide member to be fixed to the cassette so as to extend in the direction of thickness of the papers when in the cassette in the stacked state, and (ii) a through hole, in said flexible sheet, through which said guide member is to be loosely inserted.

11. The automatic paper feed apparatus according to claim 10, wherein said guide member is on a rear side of the papers when in the cassette in the stacked state.

12. The automatic paper feed apparatus according to claim 10, wherein said through hole is in a rear end of said flexible sheet.

13. The automatic paper feed apparatus according to claim 1, wherein each of the papers is of a differing thickness.

14. The automatic paper feed apparatus according to claim 13, wherein each of the papers comprises a bag having folded portions.

15. The automatic paper feed apparatus according to claim 14, wherein the bag is a medicine bag.

16. The automatic paper feed apparatus according to claim 1, wherein said flexible sheet is flaccid.

17. The automatic paper feed apparatus according to claim 16, wherein said flexible sheet comprises a urethane rubber flexible sheet or a silicon rubber flexible sheet.

18. The automatic paper feed apparatus according to claim 17, further comprising:

a first conductive layer on a top surface of said urethane rubber sheet or silicon rubber sheet; and a second conductive layer on a bottom surface of said urethane rubber sheet or silicon rubber sheet, with said first conductive layer being of a material different than a material of said second conductive layer.

19. The automatic paper feed apparatus according to claim 16, further comprising:

a first conductive layer on a top surface of said flexible sheet; and a second conductive layer on a bottom surface of said flexible sheet, with said first conductive layer being of a material different than a material of said second conductive layer.

* * * * *

UNITED STATES PATENT AND TRADEMARK OFFICE

CERTIFICATE OF CORRECTION

PATENT NO. : 7,029,003 B2
APPLICATION NO. : 10/760451
DATED : April 18, 2006
INVENTOR(S) : Kenichi Takeda et al.

It is certified that error appears in the above-identified patent and that said Letters Patent is hereby corrected as shown below:

ON THE FRONT PAGE

Item (56) References Cited:

Change "6,793,425 B1 9/2004 Yoshikawa et al. ….400/624" to --6,793,425 B2 9/2004 Yoshikawa et al. ….400/624--.

Delete the Abstract and substitute therefore the attached Abstract.

IN THE SPECIFICATION

Please replace column 1, line 1 through column 4, line 44 with the enclosed specification.

It is certified that error appears in the above-identified patent and that said Letters Patent is hereby corrected as shown below:

ABSTRACT OF THE DISCLOSURE

The present invention provides an automatic paper feed apparatus which can reliably prevent papers from being discharged in an overlapped state in spite of simple construction. The automatic paper feed apparatus comprises a paper feed roller for automatically feeding a plurality of papers in order from an uppermost one, with the plurality of papers being contained in a cassette in a stacked state. A holding member having flexibility is provided so that the holding member comes into contact with the uppermost paper to generate a friction force that is weaker than that between the paper feed roller and the uppermost paper.

It is certified that error appears in the above-identified patent and that said Letters Patent is hereby corrected as shown below:

AUTOMATIC PAPER FEED APPARATUS

BACKGROUND OF THE INVENTION

The present invention relates to an automatic paper feed apparatus for paper, especially a medicine bag.

Conventionally, an automatic paper feed apparatus having, for example, the following construction has been known.

Japanese Laid-open patent publication No. 49-67620 discloses an automatic paper feed apparatus in which a brake piece is provided on one end portion of copy papers stacked on a paper feed table to prevent two copy papers from being conveyed at a time.

Japanese Laid-open patent publication No.58-69645 discloses an automatic paper feed apparatus in which plates are interposed between stacked papers. A frictional coefficient between each plate each paper is smaller than that between adjacent papers, thereby preventing papers from being fed in an overlapped state.

In the former automatic paper feed apparatus, the brake piece has to be provided on each copy paper. In addition, a solenoid and the like is necessary to lift the brake piece so that the copy papers can be discharged from the paper feed table one by one. Thus, there has been a disadvantage in that use of this brake piece complicates construction and increases cost.

On the other hand, in the latter automatic paper feed apparatus, a complicated operation for interposing the plates between papers has been necessary.

SUMMARY OF THE INVENTION

It is certified that error appears in the above-identified patent and that said Letters Patent is hereby corrected as shown below:

An object of the invention is to provide an automatic paper feed apparatus which can reliably prevent papers from being discharged in an overlapped state in spite of simple construction.

In order to achieve the object, the present invention provides an automatic paper feed apparatus comprising a paper feed roller for automatically feeding a plurality of papers in order from an uppermost one, with the plurality of papers being contained in a cassette in a stacked state, wherein a holding member having flexibility is provided so that the holding member comes into contact with an uppermost paper to generate a friction force weaker than that between the paper feed roller and this paper.

According to the above construction, when the paper positioned uppermost is conveyed by the paper feed roller, the holding member also comes into contact with the next paper to generate a friction force, thereby preventing the next paper from being conveyed together with the uppermost paper. As the holding member has flexibility itself, it surely comes into close contact with the paper along a surface of the paper and generates a uniform friction force, thereby properly preventing any trouble of paper feed caused by the paper feed roller.

Preferably, an engagement portion is formed on a rear end portion of the holding member, wherein the engagement portion is engaged with the cassette, whereby the holding member is attached on the cassette slidably with respect to a paper feed direction. In this case, the engagement portion may be engaged with a guide portion which is provided in the cassette to guide a rear end of the paper.

According to the above construction, when the paper feed roller rotates, a paper positioned uppermost commences moving due to a friction force between the paper and the paper feed roller. Since this uppermost paper moves together with the holding member positioned thereon, it is possible to generate a proper friction force between the paper feed roller and the paper. Therefore, smooth conveyance of the paper is made possible.

Even if the paper is a medicine bag and has a different thickness by location, the holding member becomes deformed along a surface of the medicine bag and a friction force to be generated becomes uniform, thereby allowing the medicine bag to be smoothly conveyed.

Preferably, the holding member has a sheet-like shape, wherein conductive layers comprising different material are formed on top and bottom surfaces of the holding member. Thus, it is possible to select any proper one of the top and bottom faces based on differences of paper to be conveyed, and have such face come into contact with the paper.

BRIEF DESCRIPTION OF THE DRAWINGS

Figure 3:
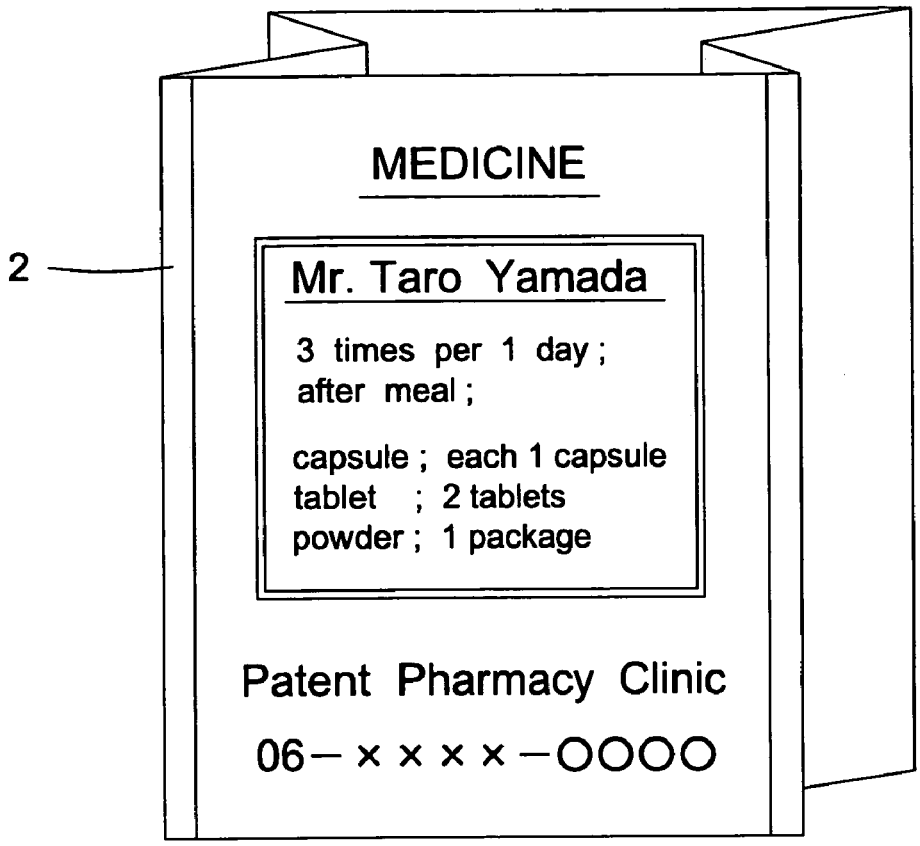
FIG. 3 is a perspective view showing a medicine bag in a state before completion as an example of the paper.

Further objects and advantages of the present invention will become clear from the following description taken in conjunction with the preferred embodiments thereof with reference to the accompanying drawings, in which:

Fig. 1 is a side view of a medicine bag printing apparatus according to an embodiment of the present invention;

Fig. 2 is a front view of the medicine bag printing apparatus of Fig. 1;

Fig. 3 is a perspective view showing a medicine bag in a state before completion as an example of a paper;

Fig. 4 is a front sectional view of a cassette mounted on the medicine bag printing apparatus of Figs. 1 and 2;

Fig. 5 is a side sectional view of the cassette of Fig. 4;

Fig. 6 is a partly enlarged view of Fig. 5;

Fig. 7 is a perspective view of a flexible sheet of Figs. 4 and 5; and

It is certified that error appears in the above-identified patent and that said Letters Patent is hereby corrected as shown below:

Fig. 8 is an enlarged sectional view of the flexible sheet of Fig. 6.

DETAILED DESCRIPTION OF THE PREFERRED EMBODIMENTS

Hereinbelow, embodiments of the invention will be described with reference to the accompanying drawings.

Figs. 1 and 2 show a medicine bag printing apparatus according to an embodiment of the present invention. The medicine bag printing apparatus comprises an automatic paper feed apparatus 1 and a printing apparatus 3 for conducting a predetermined print on a paper 2 fed from the automatic paper feed apparatus 1. In this embodiment, a medicine bag (refer to Fig. 3) of which both side edges are stuck and become thick is used as the paper 2.

In the automatic paper feed apparatus 1, a cassette 5 can be mounted into and dismounted from each of housing spaces 4 formed in a multistage in a vertical direction. As shown in Fig. 5, in each housing space 4 is provided a paper feed roller 6 which is driven to rotate by a drive device such as motor (not shown). The paper feed roller 6 comes into contact with the paper 2 contained in the cassette 5 and positioned uppermost so that the paper 2 is conveyed and fed due to a friction force generated between the feed roller and the paper. (Hereinafter, a direction in which the paper is fed is referred to as “front” and a reverse direction thereof is referred to as “rear”.)

The cassette 5 has a box like shape with an upper surface opened as shown in Figs. 4 and 5. On a front end face of the cassette 5 is formed an engagement recess 7 with which fingers of an operator are engaged when the cassette 5 is drawn from housing space 4. On a bottom of the cassette 5, a support plate 20 is provided pivotably around a support shaft 10 via arms 11. A flat portion 8 of the support plate 20 positioned on a front end side is urged upwardly by a spring 9. On the support plate 20, guide plates 12 are slidably provided in a width direction to guide both side edges of the paper 2 contained in the cassette 5. On an upper face of the flat portion 8 of the support plate 20, guide protrusions 13 are formed to support a middle portion of the medicine bag, i.e., a thinner portion than side edge portions thereof. On a bottom of the cassette 5 on a rear side, a guide piece 14 is slidably provided in a paper feed direction to guide a rear end of the paper 2. On an upper end of the guide piece 14 is formed an engagement claw 15 protruding toward a front side.

the cassette 5, the same size of papers 2 are contained in a stacked state. (The size of papers 2 contained in each of the cassettes 5 is the same in one case but different in another case.) The papers 2 are sandwiched between the support plate 20 urged upwardly by the spring 9 and the paper feed roller 6 in a state that the cassette 5 is mounted in the housing space 4.

On a rear side of the paper feed roller 6, a flexible or flaccid sheet 16 as an example of a holding member of the present invention is put on the paper 2 contained in the cassette 5. The flexible sheet 16 as shown in Fig. 7 is made of urethane rubber, silicon rubber or the like. The flexible sheet 16 comes into close contact with the paper 2 in an area except a portion pressed by the paper feed roller 6. On a rear end of the flexible sheet 16 is integrally formed an attachment piece 17 that is made of metal material such as stainless steel and has a rectangular shape. In the attachment piece 17 is formed a rectangular engagement hole 18 into which the guide piece 14 is inserted so that the flexible sheet 16 is slidably attached in the paper feed direction of the paper 2.

In the medicine bag printing apparatus of above construction, the paper feed roller 6 is driven to rotate in housing space 4 in which is mounted cassette 5 containing papers 2 of size corresponding to a prescription data. At this time, a friction force is generated between paper feed roller 6 and an uppermost paper 2 urged upwardly by spring 9. A spring force exerted by the spring is large in comparison to a weight of flexible sheet 16 which comes into close contact with the uppermost paper 2. Therefore, the uppermost paper 2 and the flexible sheet 16 commence moving together as the paper feed roller 6 rotates. Thus, in comparison to a case that no flexible sheet is provided, a state of conveying the paper 2 becomes stable. That is, in a case of only paper 2, there is a possibility that the paper 2 is conveyed with a skew according to a slight difference of condition such as a contact condition between the paper 2 and the paper feed roller 6. On the other hand, in the case that the flexible sheet is provided, since an influence of the weight of the flexible sheet becomes larger, no bad influence is exerted to conveyance of the paper 2 even if a condition is slightly different, for example, a contact pressure between the paper 2 and the paper feed roller 6 is different in a width direction.

When rotation of the paper feed roller 6 allows the paper 2 and the flexible sheet 16 to move, an edge of engagement hole 18 of attachment piece 17 comes into contact with guide piece 14, thereby inhibiting the flexible sheet 16 from moving further. The friction force generated between the paper feed roller 6 and the uppermost paper 2 is larger than a friction force generated between the paper 2 and the flexible sheet 16 which comes into close contact with the paper 2. Therefore, only the paper 2 keeps moving. Movement of only the uppermost paper 2 allows a part of the flexible sheet l6 to come into close contact with a surface of next paper 2 as shown in Fig. 6. A frictional coefficient between the paper 2 and the flexible sheet 16 is lager than a frictional coefficient between adjacent papers 2. Therefore, the next paper 2 is prevented from being moved by a friction force of the flexible sheet 16, whereby only the paper 2 positioned uppermost can be conveyed as the paper feed roller rotates.

Thus, in the embodiment explained above, putting the flexible sheet 16 on stacked paper 2 enables to be neglected a slight difference of condition that has been a problem when conveying paper 2 by paper feed roller 6, resulting in good conveyance of the paper 2. Therefore, the paper 2 can be conveyed stably and straight. Even in a case of printing, a printing direction never skews. In addition, after commencement of conveying, the flexible sheet 16 holds the next paper 2, thereby preventing a disadvantage in that papers 2 are conveyed in a overlapped state.

In the embodiment described above, the flexible sheet 16 is explained as an example of the holding member, though the holding member may be a plurality of line-like members or straps, or may also be a mesh-like member. Also, the holding member may be a sheet-like member with various kinds of shapes formed on a surface thereof. Moreover, it is also possible to stick an other member, such as sponge, on a surface of the holding member to generate a predetermined friction force between such member and paper 2.

In addition, a coating of conductive material may be applied on a top face of the flexible sheet 16, or carbon or the like may be impregnated in a surface of the flexible sheet 16, thereby preventing a bad influence due to static electricity generated on paper 2. In this case, as shown in Fig. 8, coatings 16a and 16b of different conductive material (for example, carbon and aluminum) may be preferably applied on top and bottom faces of the flexible sheet 16 to be used either according to a difference (for example, normal quality paper and propylene) of paper 2 to be used.

As is clear from the above description, according to the present invention, because a flexible sheet is put on paper in a cassette, it is possible to reliably feed only one paper.

UNITED STATES PATENT AND TRADEMARK OFFICE

CERTIFICATE OF CORRECTION

PATENT NO. : 7,029,003 B2
APPLICATION NO. : 10/760451
DATED : April 18, 2006
INVENTOR(S) : Kenichi Takeda et al.

It is certified that error appears in the above-identified patent and that said Letters Patent is hereby corrected as shown below:

Although the present invention has been fully described by way of examples with reference to the accompanying drawings, it is to be noted that various changes and modifications will be apparent to those skilled in the art. Therefore, unless such changes and modifications otherwise depart from the spirit and scope of the present invention, they should be construed as being included therein.

Signed and Sealed this

Twenty-eighth Day of November, 2006

JON W. DUDAS
*Director of the United States Patent and Trademark Office*